US011255092B2

(12) United States Patent
Rasmussen et al.

(10) Patent No.: US 11,255,092 B2
(45) Date of Patent: Feb. 22, 2022

(54) CHANNELED PLANK SIDING

(71) Applicant: QUALITY EDGE, INC., Walker, MI (US)

(72) Inventors: C. Scott Rasmussen, Ada, MI (US); Zachary Pritchard, Stanwood, MI (US)

(73) Assignee: QUALITY EDGE, INC., Walker, MI (US)

( * ) Notice: Subject to any disclaimer, the term of this patent is extended or adjusted under 35 U.S.C. 154(b) by 0 days.

(21) Appl. No.: 17/068,350

(22) Filed: Oct. 12, 2020

(65) Prior Publication Data

US 2021/0025175 A1 Jan. 28, 2021

Related U.S. Application Data

(63) Continuation-in-part of application No. 17/005,366, filed on Aug. 28, 2020, which is a continuation of application No. 16/689,277, filed on Nov. 20, 2019, now Pat. No. 10,760,282, which is a continuation of application No. 16/216,107, filed on Dec. 11, 2018, now Pat. No. 10,508,455.

(51) Int. Cl.
*E04F 13/08* (2006.01)
*E04F 13/12* (2006.01)

(52) U.S. Cl.
CPC ..... *E04F 13/0869* (2013.01); *E04F 13/0864* (2013.01); *E04F 13/0889* (2013.01); *E04F 13/12* (2013.01)

(58) Field of Classification Search
USPC ..... 52/302.4, 309.8, 309.9
See application file for complete search history.

(56) References Cited

U.S. PATENT DOCUMENTS 2,258,247 A * 10/1941 Hull ..... E04F 13/0864 52/530
2,591,361 A * 4/1952 Knott ..... E04F 13/0814 52/489.1
2,642,968 A * 6/1953 Roush ..... E04F 13/0803 52/520
3,188,774 A 6/1965 McCorkle
3,325,952 A 6/1967 Trachtenberg
3,473,274 A * 10/1969 Godes ..... E04F 13/0864 52/127.5
4,102,106 A * 7/1978 Golder ..... E04F 13/0864 52/533
4,122,643 A * 10/1978 Hafner ..... E04F 13/0864 52/520
4,327,528 A * 5/1982 Fritz ..... E04B 1/7612 52/309.1
4,593,512 A * 6/1986 Funaki ..... E04F 13/0864 52/519
5,016,415 A * 5/1991 Kellis ..... E04F 13/0864 52/522
5,363,623 A * 11/1994 King ..... B29D 99/001 52/520

(Continued)

*Primary Examiner* — Joshua K Ihezie
(74) *Attorney, Agent, or Firm* — Price Heneveld LLP

(57) ABSTRACT

A building siding panel is provided with an internal channel for weeping away water and the ability to hide the securing flange when the siding panel is installed on a building wall. The siding panel can be customized to have the look of a wooden panel, while retaining the benefits and durability of a non-wooden material, such as metal.

20 Claims, 12 Drawing Sheets

(56) References Cited

U.S. PATENT DOCUMENTS 5,560,170 A * 10/1996 Ganser ..... E04F 13/0864 52/212
5,581,970 A * 12/1996 O'Shea ..... E06B 1/62 52/204.53
5,598,677 A * 2/1997 Rehm, III ..... E04D 1/2916 52/407.1
5,694,728 A * 12/1997 Heath, Jr ..... E04D 3/32 52/518
5,862,912 A * 1/1999 Schelhorn ..... B65D 71/00 206/321
5,878,543 A * 3/1999 Mowery ..... E04F 13/0864 52/519
6,223,488 B1 * 5/2001 Pelfrey ..... E04D 13/152 52/302.1
6,295,777 B1 * 10/2001 Hunter ..... E04F 13/0864 52/311.1
6,988,345 B1 * 1/2006 Pelfrey ..... E04F 13/0864 52/519
7,040,067 B2 * 5/2006 Mowery ..... E04F 13/0864 52/309.8
8,006,455 B1 8/2011 Mollinger
8,336,269 B1 * 12/2012 Mollinger ..... E04F 13/007 52/302.4
8,381,472 B1 2/2013 Fleenor
9,068,362 B1 6/2015 Baxter et al.
10,508,455 B1 * 12/2019 Bredeweg ..... E04F 13/12
2006/0053715 A1 * 3/2006 Mowery ..... E04F 13/0876 52/309.8
2006/0075712 A1 * 4/2006 Gilbert ..... E04F 13/0869 52/520
2008/0141607 A1 * 6/2008 Stoecker ..... E04F 13/12 52/478
2009/0126286 A1 * 5/2009 Sigmund ..... E04D 13/178 52/95
2009/0301015 A1 12/2009 Simms
2010/0064611 A1 * 3/2010 Holt ..... E04C 2/243 52/309.4
2016/0153197 A1 * 6/2016 Baum, Jr. ..... B21D 5/08 428/18

* cited by examiner

CHANNELED PLANK SIDING

CLAIM OF PRIORITY

The present application is a continuation-in-part of commonly assigned U.S. patent application Ser. No. 17/005,366, filed Aug. 28, 2020, entitled CHANNELED PLANK SIDING, which is a continuation of U.S. Pat. No. 10,760,282, issued Sep. 1, 2020, entitled CHANNELED PLANK SIDING, which is a continuation of U.S. Pat. No. 10,508,455, issued Dec. 17, 2019, entitled CHANNELED PLANK SIDING, all of which are incorporated herein by reference.

BACKGROUND

The present invention generally relates to modular plank siding and, more specifically, to modular plank siding that incorporates an internal drainage system.

BRIEF SUMMARY OF THE INVENTION

One aspect of the present invention includes a siding panel to be attached to a building. The siding panel has an elongated body with an inner face and an outer face. A securing flange is located near the upper end of the siding panel and is in a generally horizontal orientation when the siding panel is attached to the surface of a building. The securing flange portion also has a plurality of fastener openings. The securing flange includes a plurality of stiffening ridges. The securing flange is spaced away from the outer face of the elongated body of the siding panel a first distance, spacing the inner face of the siding panel a distance away from the side of the building. The siding panel includes a receiving channel located near the bottom of the securing flange. A tab portion is located near the lower end of the elongated body of the siding panel. The tab portion is also in a generally horizontal orientation when the siding panel is attached to a surface of a building. The tab portion is spaced away from the outer face of the elongated body a second distance, which is less than the first distance. The siding panel includes an inner channel formed by an inclined surface between the inner face of the elongated body and the tab portion. The inner channel includes one or more weep holes. A first inclined edge located near the upper end of the elongated body such that when panels are placed vertically adjacent each other, the weep holes of the top panel are positioned above an inclined edge of the lower adjacent elongated panel to divert water away from the building.

In another aspect, the invention includes a building siding system. The siding panel has an elongated body with a generally horizontal upper end and a generally horizontal lower end when the siding panel is secured in a generally horizontal orientation to the building wall. The elongated body has an outer face oriented away from the building wall and an inner face oriented toward the building wall. A securing flange extends from the siding panel with a plurality of fastener openings. The securing flange is spaced away from the outer face of the elongated body a first distance. The securing flange also has a plurality of stiffening ridges. Fasteners are secured through the fastener openings to attach the siding panel to the building wall. The siding panel includes a receiving channel located between a portion of the securing flange and a generally vertical portion of the siding panel spaced away from the securing flange, the bottom of the receiving channel being generally U-shaped. The siding panel includes a tab portion located near the generally horizontal lower end of the elongated body, with the tab portion being spaced away from the outer face of the elongated body a second distance. The panel includes an inner channel formed by a second inclined surface that extends from the bottom of the generally horizontal lower end to the top of the tab portion. The first inclined surface extends from the generally horizontal upper end toward a portion of the securing flange. Weep holes are positioned in the lower end of the inner channel. The distance between the tab portion and the elongated body is smaller than the distance between the securing flange and the elongated body.

In yet a further aspect, the invention includes an insert for a siding panel. The insert includes an outer surface and a generally parallel inner surface. The insert has an upper inclined surface extending on an angle upward from the outer surface and a lower inclined surface extending upwardly from the bottom of the outer surface to the bottom of the inner surface.

These and other features, advantages, and objects of the present invention will be further understood and appreciated by those skilled in the art by reference to the following specification, claims, and appended drawings.

DETAILED DESCRIPTION

Figure 1:
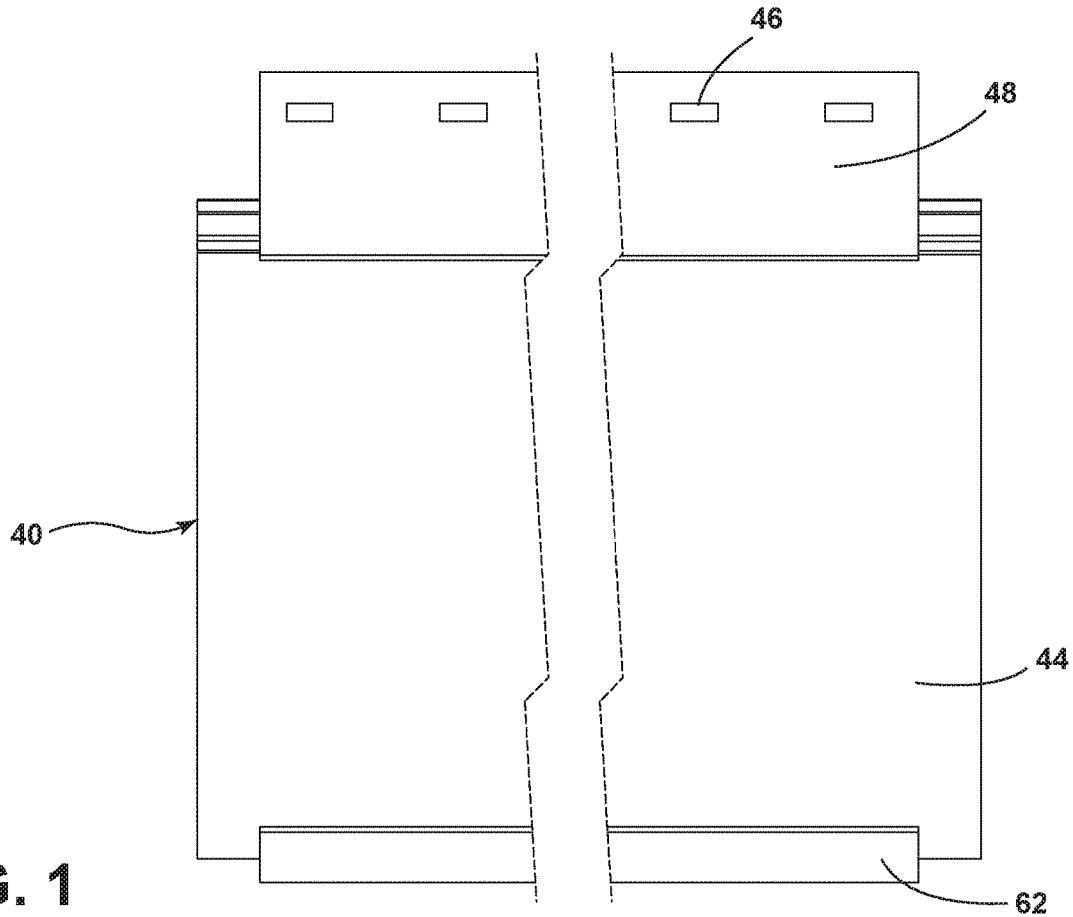
FIG. 1 is a partial rear view of a siding panel according to one embodiment of the present invention.

As referenced in the figures, the same reference numerals may be used herein to refer to the same parameters and components or their similar modifications and alternatives.

For purposes of description herein, the terms "upper," "lower," "right," "left," "rear," "front," "vertical," "horizontal," and derivatives thereof shall relate to the present disclosure as oriented in the Figures. However, it is to be understood that the present disclosure may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise. The drawings referenced herein are schematic and associated views thereof are not necessarily drawn to scale.

Figure 2:
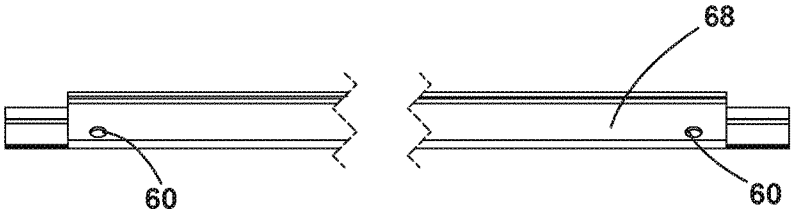
FIG. 2 is a bottom view of the siding panel shown in FIG. 1.
Figure 4:
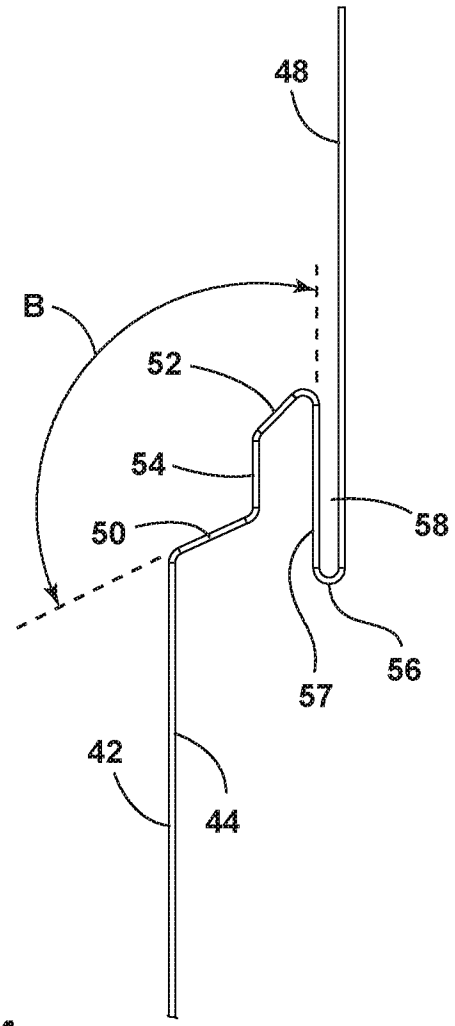
FIG. 4 is an enlarged cross-sectional view of the siding panel shown in FIG. 1, taken along line IV as shown in FIG. 3.
Figure 3:
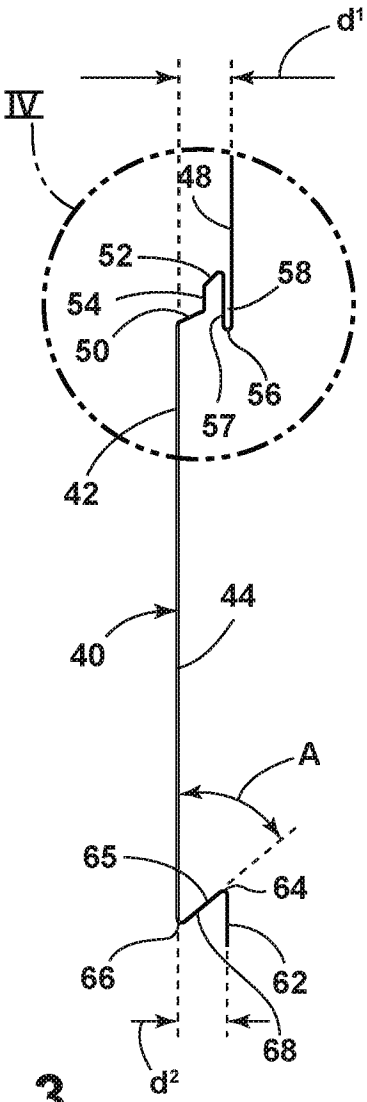
FIG. 3 is a cross-sectional view of the siding panel shown in FIG. 1.
Figure 5:
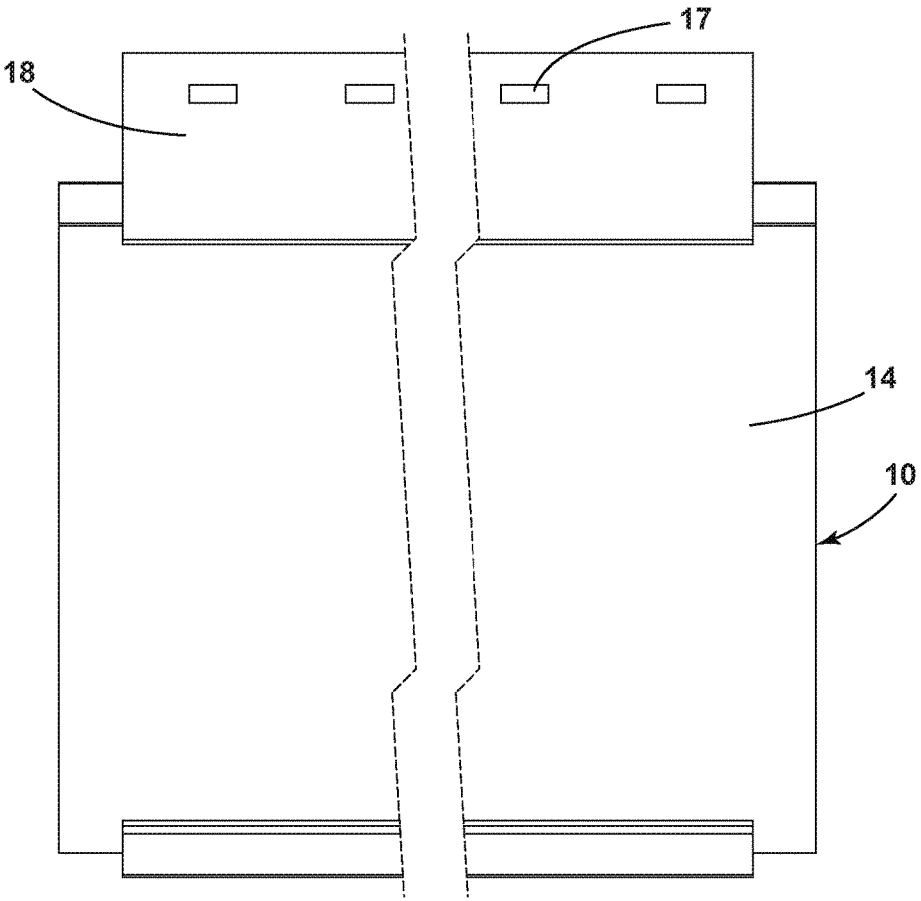
FIG. 5 is a rear view of siding panel according to another embodiment of the present invention.
Figure 6:
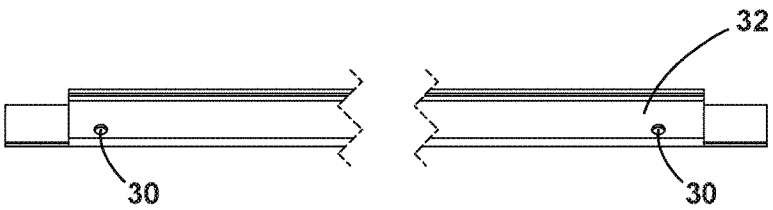
FIG. 6 is a bottom view of the siding panel shown in FIG. 5.
Figure 9:
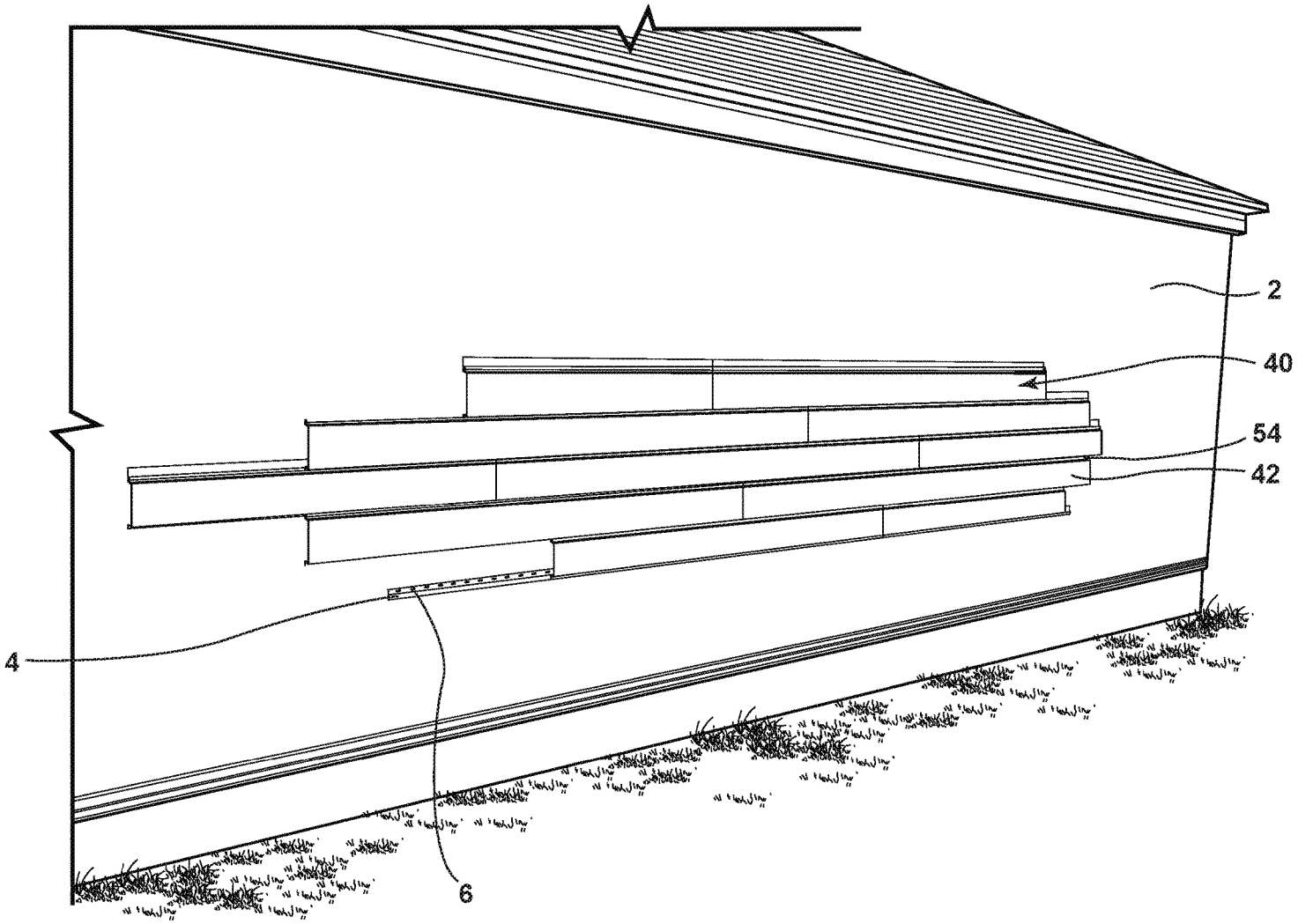
FIG. 9 is a front perspective view of the siding panel shown in FIG. 1, installed on the side of a building.
Figure 10:
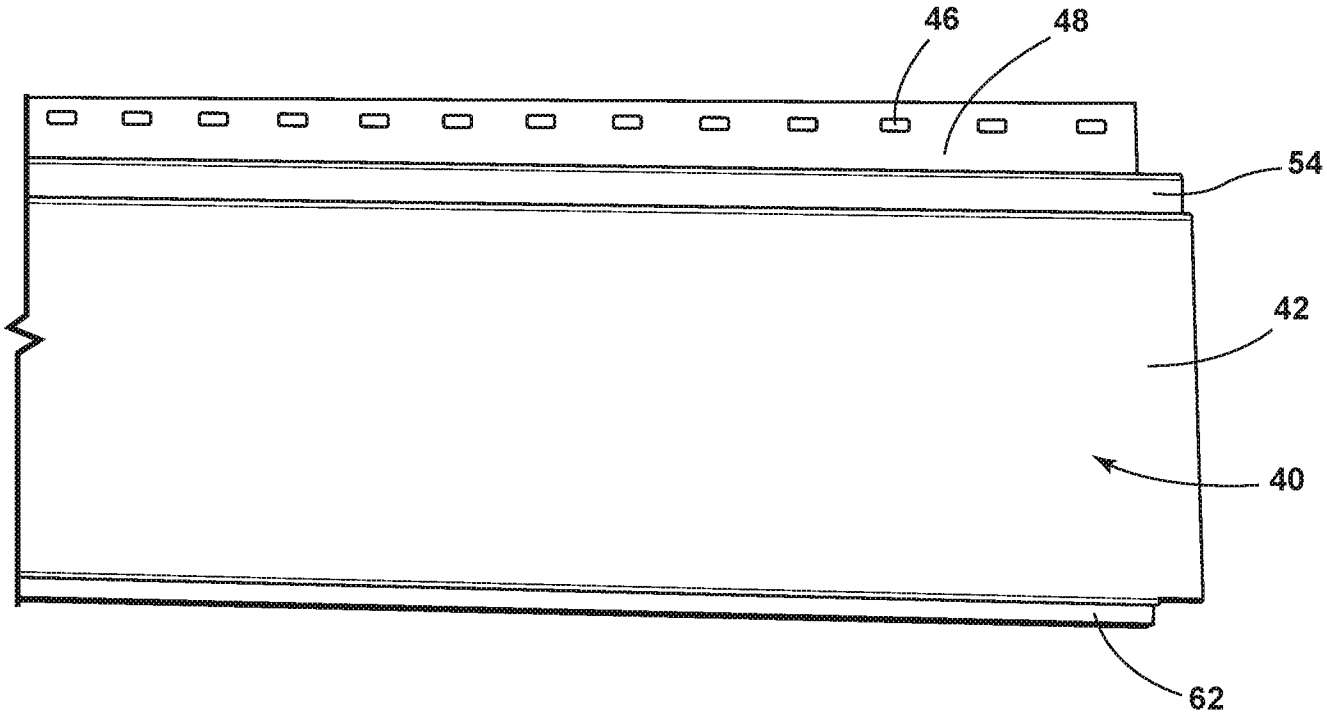
FIG. 10 is a front perspective view of the siding panel shown in FIG. 1.
Figure 11:
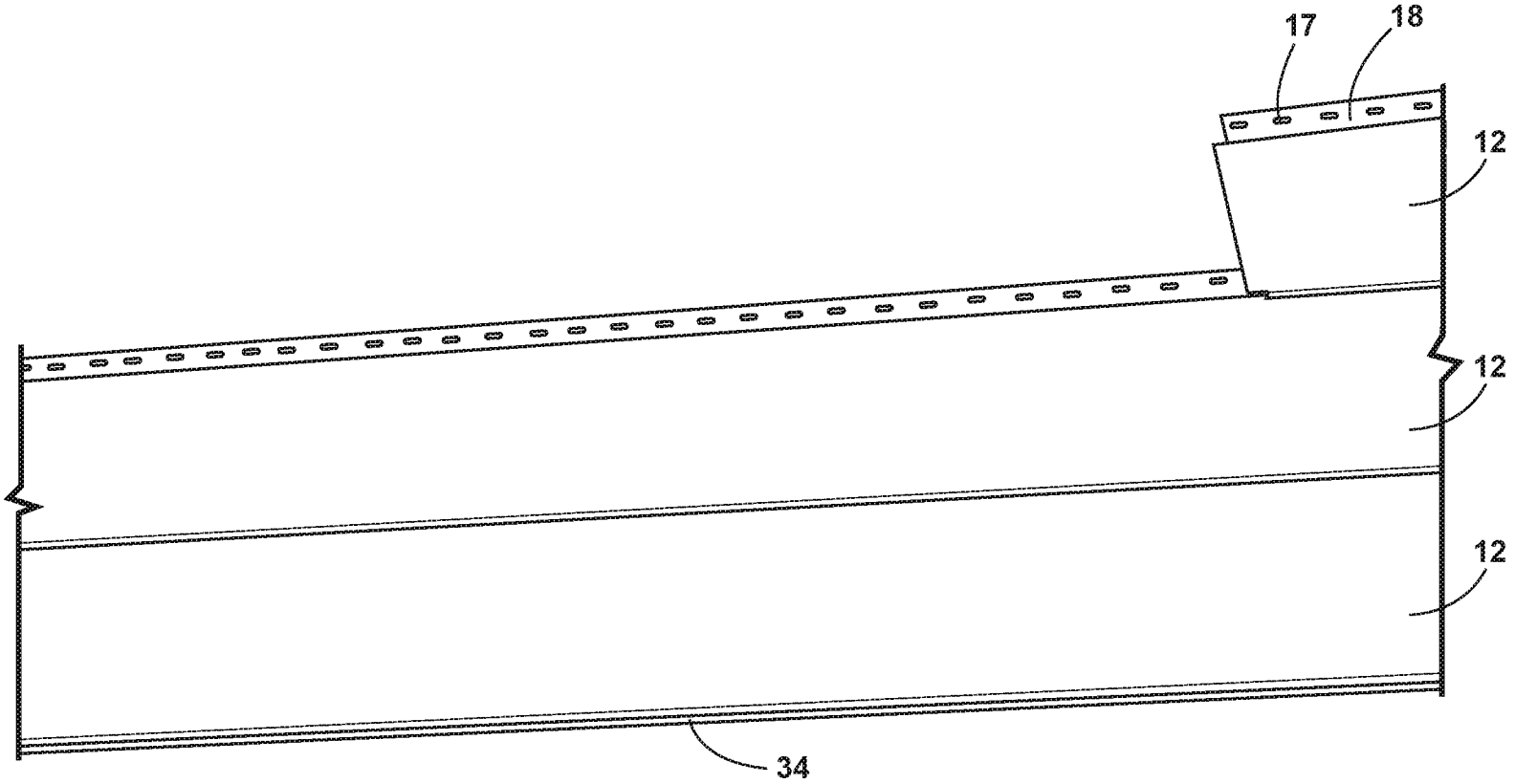
FIG. 11 shows a number of the siding panels of the embodiment shown in FIG. 5 connected together.

As referred to in FIGS. 1-4, an embodiment of a sliding panel 40 is shown. The siding panel 40 includes an inner face 44 and an outer face 42, as shown in FIG. 3. The siding panel 40 is an elongated panel that will be installed in a generally horizontal fashion, as illustrated in FIG. 9. The siding panel 40 includes a securing flange portion 48 that has a number of fastener openings 46. As illustrated in FIGS. 3 and 4, the securing flange portion 48 is generally parallel to the inner face 44 and outer face 42 of the siding panel 40. A first upper inclined surface 50 extends from the upper end of the elongated body toward the securing flange 48. The embodiment shown in FIGS. 1-4 includes a recessed face portion 54 that is generally parallel to the outer face portion 42 and will be visible when installed, as illustrated in FIG. 9. The upper inclined surface 50 is at an angle B to the recessed face portion 54 of the siding panel 40 of approximately 110° to 120°, and more preferably approximately 115°. A second upper inclined surface 52 extends upwardly from the recessed face portion 54. The siding panel 40 includes a receiving channel 58, which is formed between the securing flange portion 48 and a wall 57 that is generally parallel to both the securing flange portion 48 and the inner face 44 of the siding panel 40. The receiving channel 58 can include a generally U-shaped bottom 56.

The siding panel 40 also includes a tab portion 62. The tab portion 62 extends generally parallel to the inner face 44 and outer face 42 of the siding panel 40. A lower inclined surface 68 extends from the bottom of the siding panel 40 and includes a curved portion 66 where the inclined surface 68 extends from the lower portion of the siding panel 40 and a curve 64 where the inclined surface 68 meets the tab 62. As illustrated in FIG. 3, the angle A between the inclined surface 68 and the inner face 44 is in the range of 40° to 60°, and more preferably 50°.

The inclined surface 68 and the inner face 44 of the siding panel 40 form an inner channel 65, as illustrated in FIG. 3. A plurality of weep holes 60 are located in the inner channel 65, as illustrated in FIG. 2.

Figure 8:
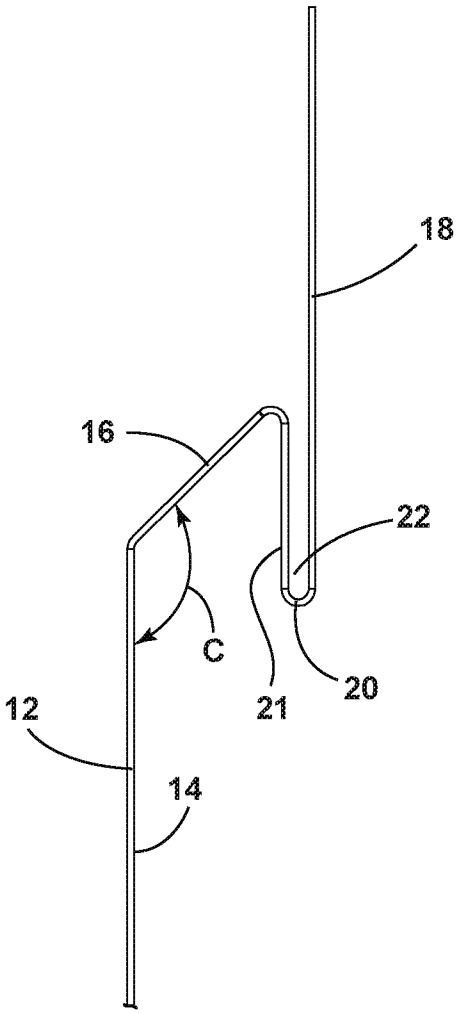
FIG. 8 is an enlarged cross-sectional view of the siding panel shown in FIG. 5, taken along the line VIII as shown in FIG. 7.

Another embodiment is illustrated in FIGS. 5-8. In that embodiment, the siding panel 10 includes an outer face 12 and an inner face 14. An upper inclined surface 16 extends from the upper end of the siding panel 10. As illustrated in FIG. 8, the angle C between the inclined surface 16 and the inner face 14 of the siding panel 10 is in the range of 125° to 145° and more preferably approximately 135°. A securing flange 18 extends vertically and is generally parallel to the inner face 14 and outer face 12 of siding panel 10. A receiving channel 22 is located between the securing flange 18 and a generally vertical wall 21 that is generally parallel to both the securing flange 18 and the inner face 14 of the siding panel 10. The receiving channel 22 can include a generally U-shape bottom 20, as illustrated in FIG. 8.

Figure 7:
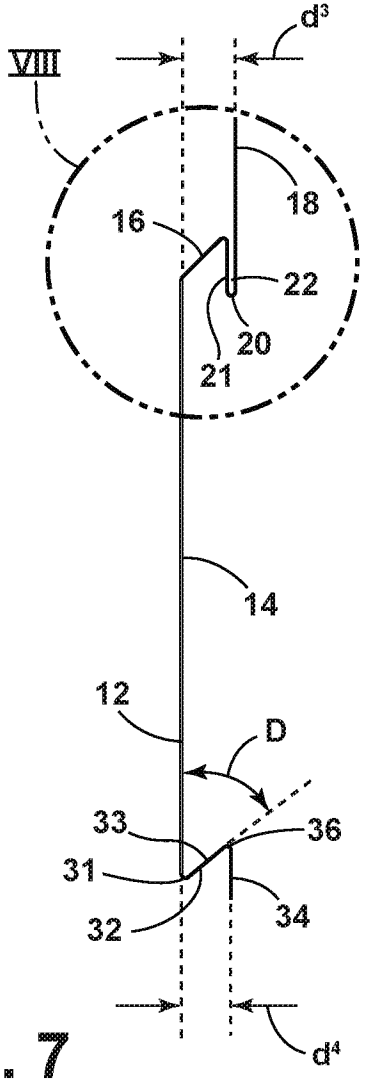
FIG. 7 is a cross-sectional view of the siding panel shown in FIG. 5.

The siding panel 10 has a tab 34 located near the bottom end of the panel 10. As illustrated in FIG. 7, the tab portion 34 is generally parallel to the inner face 14 of the siding panel 10. A lower inclined surface 32 extends from the bottom of the siding panel 10 and connects to the tab portion 34, as illustrated in FIG. 7. A curved portion 31 exists where the siding panel 10 transitions from the outer face portion 12 to the lower inclined surface 32. Similarly, a curved portion 36 exists where the siding panel 10 transitions from the inclined portion 32 to the tab portion 34. The angle D between the inner face 14 and the lower inclined surface 32 is in the range of 40° to 60°, and more preferably approximately 50°.

As illustrated in FIG. 3, the distance d1 between the outer face 42 of the siding panel 40 and the tab portion 58 is greater than the distance d2 between the outer face 42 and the tab portion 62. For example, d1 could be approximately 0.46 inches, while d2 is approximately 0.40 inches. Similarly, in the embodiment shown in FIG. 7, the distance between the outer face 12 and the tab portion 18 d3 is greater than the distance d4 between the outer face 12 and the tab portion 34. For example, d3 could be approximately 0.46 inches, while d4 is approximately 0.40 inches. The difference in distances could be in the range of 0.01 to 0.12 inches, with a preferred distance of approximately 0.06 inches.

Figure 15:
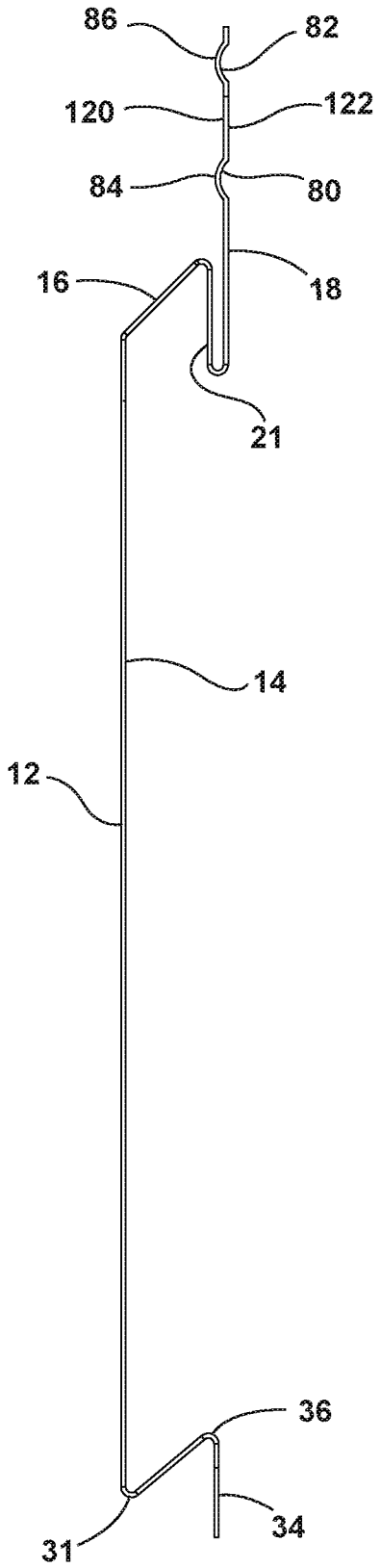
FIG. 15 is a cross-sectional view of the siding panel shown in FIG. 13.

Another embodiment is illustrated in FIGS. 13-15 and 17. In that embodiment, the siding panel 10 is similar to the siding panel illustrated in FIGS. 5-8 with the addition of stiffening ridges 84, 86. The illustrated stiffening ridges 84, 86 include a generally convex surface of the outer surface 120 of the siding panel 10, as shown in FIG. 15. The back side 122 of the siding panel 10 includes corresponding concave surfaces 80, 82 for the stiffening ridges 84, 86. The stiffening ridges 84, 86 are shown on portions of the securing flange 18, one stiffening ridge 84 below the fastener openings 17 and one stiffened ridge 86 above the fastener openings 17. While the illustrated embodiment of FIGS. 13-15 and 17 show two stiffening ridges 84, 86, one or more stiffening ridges 84, 86 can be used and they can be located in various positions on the siding panel 10. The stiffening ridges 84, 86 help provide additional strength to prevent, among other things, deformation of the securing flange 18 as fasteners are installed in the fastener openings 17.

While the stiffening ridges 84, 86 are shown in generally parallel orientation to the outer face 12 of the siding panel 10, the stiffening ridges 84, 86 may be used in other orientations and/or with other shaped stiffening ridges 84, 86.

Figure 16:
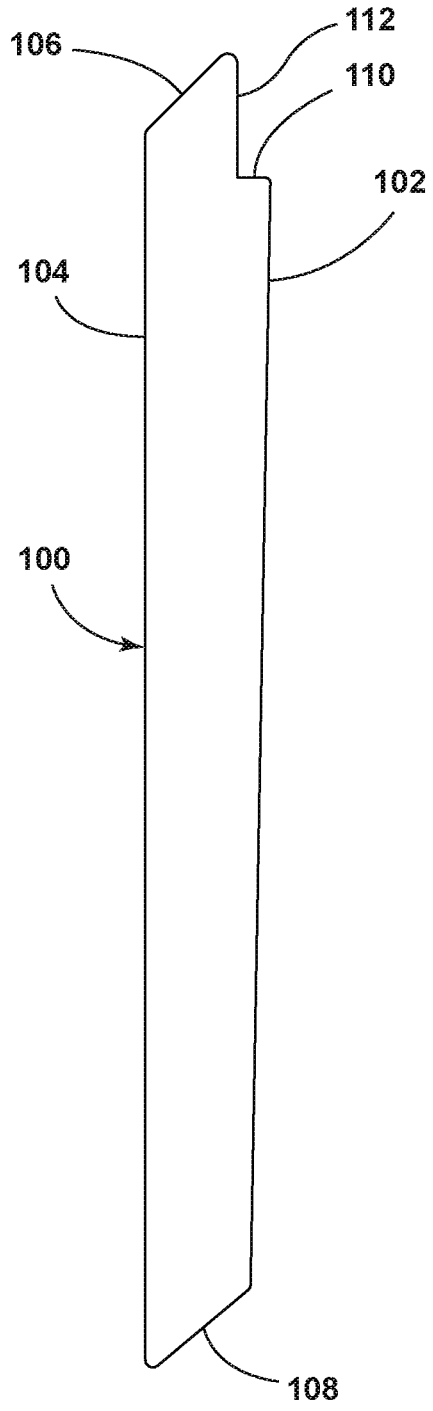
FIG. 16 is a side view of an insert according to another embodiment of the present invention.
Figure 17:
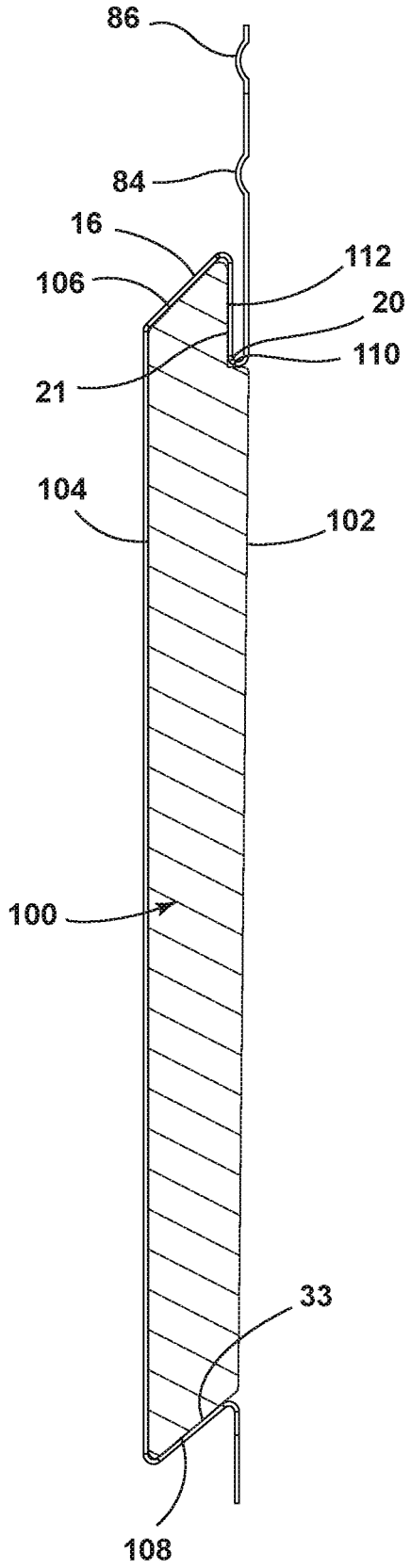
FIG. 17 is a cross-sectional view of the insert shown in FIG. 16 installed in the siding panel shown in FIG. 13.

An insert 100 is shown in FIGS. 16 and 17. The insert 100 includes an outer surface 104 and an inner surface 102. The insert 100 is designed to be placed into the siding panel 10 such that an upper inclined surface 106 of the insert 100 is adjacent to the upper inclined surface 16 of the siding panel 10. A shoulder 110 on the insert 100 will be adjacent to the U-shaped bottom 20 of the siding panel 10. A lower inclined surface 108 of insert 100 will be adjacent the channel 33 of the siding panel 10. The inner surface 102 of insert 100 will be adjacent the surface of the building, while the outer surface 104 will be adjacent to the inner face 14 of the siding panel 10. Surface 112 of insert 100 will be adjacent to the generally vertical wall 21 of siding panel 10. Thus, the insert 100 is adjacent to and/or can contact multiple surfaces of the siding panel 10.

The inserts 100 add strength to the siding panel 10 and can prevent distortion of the siding panels 10 during installation and/or weather-related events. The inserts 100 can be spaced at intervals along the siding panel 10. The inserts 100 can be of varying widths and can be used in varying spacing with the siding panels 10. The insert 100 can be made of any material that will provide structural support for the siding panels 10. The materials used to make insert 100 include, but are not limited to, polymeric materials, foams, wood, or metal. The insert 100 can have gaps, holes, perforations, or other structure to lighten the insert 100 while maintaining the ability of the insert 100 to structurally support the siding panels 10. The inserts 100 can be used where adjacent panels 10 overlap or otherwise couple together. The inserts 100 can also be used away from the edges of the siding panel 10. The inserts 100 can be coupled to the building and/or the siding panel 10 using adhesives, fasteners, mechanical interfaces, or other coupling mechanisms.

Figure 12:
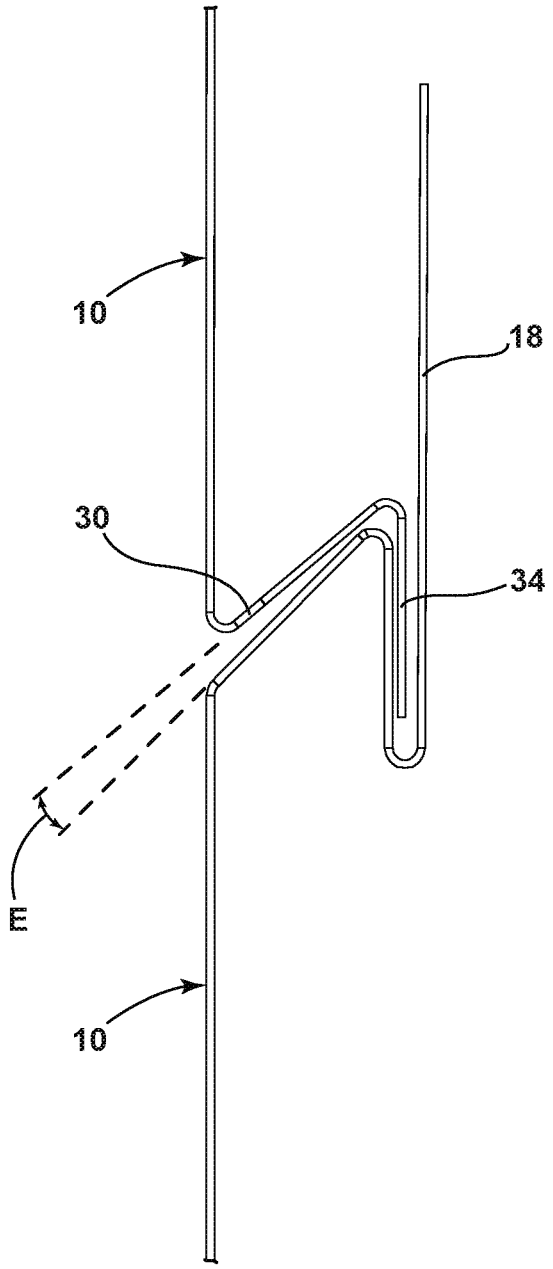
FIG. 12 is a partial enlarged cross-sectional view of two siding panels of FIG. 5.
Figure 13:
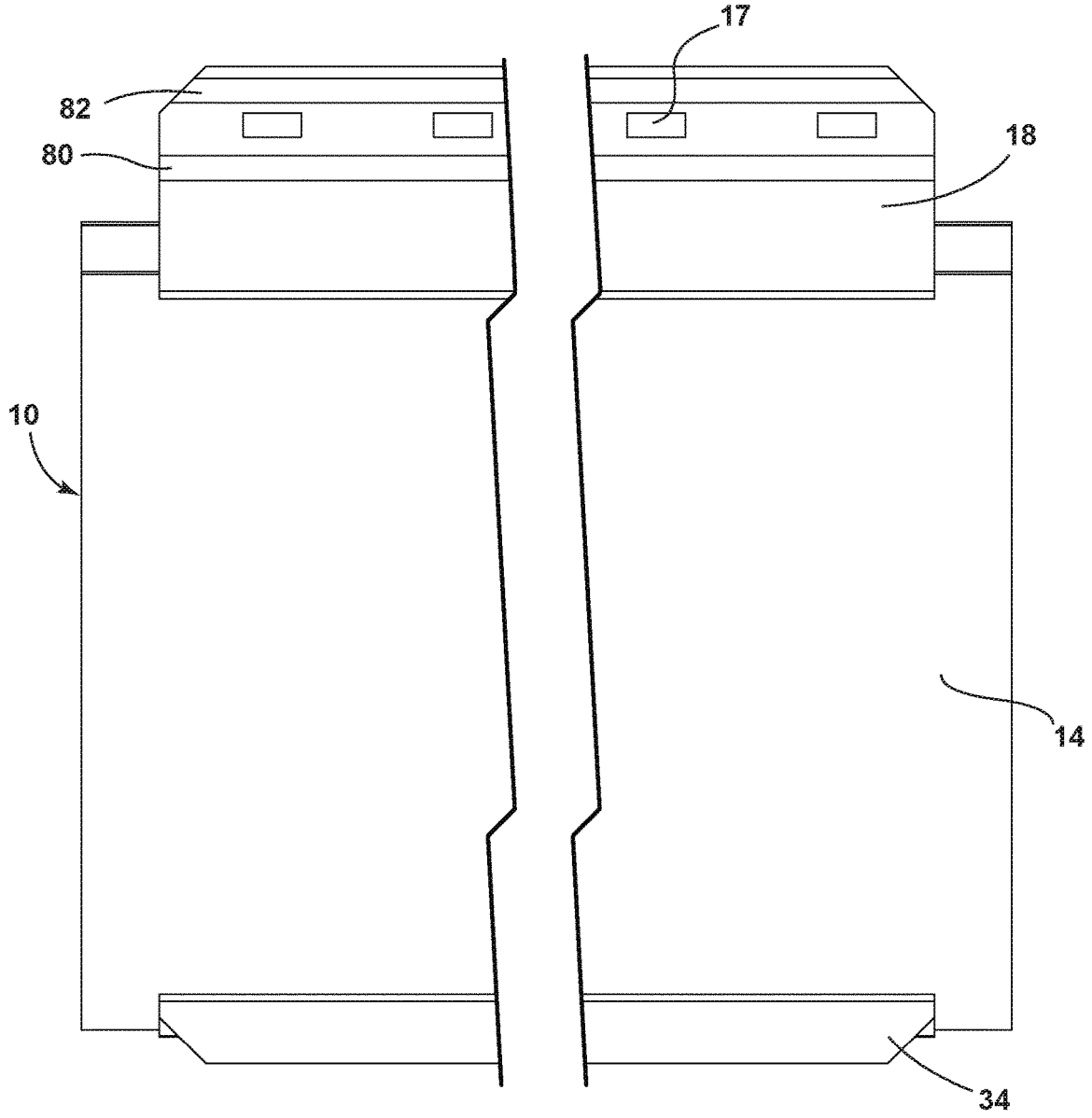
FIG. 13 is a partial rear view of a siding panel according to another embodiment of the present invention.
Figure 14:
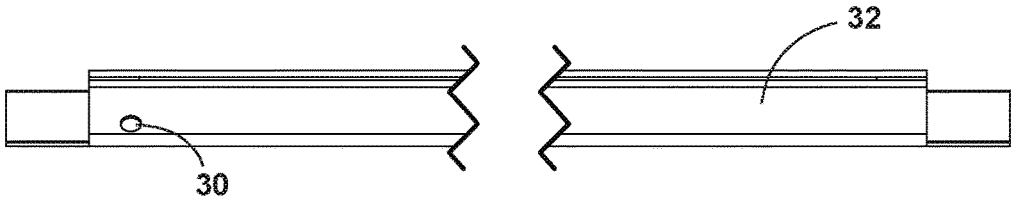
FIG. 14 is a bottom view of the siding panel shown in FIG. 13.

As illustrated in FIG. 12, when an adjacent siding panel 10 is installed above an adjacent siding panel 10, the tab portion 34 of the upper siding panel 10 is received by the receiving channel 22 of the lower siding panel 10. In this arrangement, the lower inclined surface 32 of the upper siding panel 10 will be positioned next to the upper inclined surface 16 of the lower siding panel 10. This permits the weep holes 30 to allow any water collected in the inner channel 33 of the upper siding panel 10 to drip onto the upper inclined surface 16 of the adjacent lower siding panel 10. The upper inclined surface 16 causes any water that falls onto it from the weep hole 30 of the above siding panel 10 to move away from the surface of the building wall 2. As illustrated in FIG. 12, the difference in angles C and D results in an open angle E that allows air to flow in and out of the weep holes 30.

The tab portion 34 can include an additional hinge portion of material (not shown) that can be compressed when the tab 34 is placed into the receiving channel 20 of an adjacent siding panel 10. The hinge portion can be attached, for example, to the lower portion of the tab 34 and extend upwardly at a slight angle away from the tab portion 34. The tab portion 34 can also be loosely received in the receiving channel 20, as illustrated in FIG. 12.

Similarly, the siding panel 40 with the recessed face 54 can be installed on the side of the building wall 2, as illustrated in FIG. 9. As shown in FIG. 9, a started strip 4, which includes a plurality of fasteners openings 6, can be installed in a generally horizontal manner on the building wall 2. When the panels are installed the recessed face 54 and the outer face 42 of the panels 40 can seen. When that siding panel 40 is installed adjacent to another siding panel 40, the tab portion 62 of the upper siding panel 40 is received in a receiving channel 58 of the lower siding panel 40. The lower inclined surface 68 will be positioned next to the second upper inclined surface 52, permitting the recessed face 54 to be seen when the siding panel 10 is installed. The weep holes 60 will permit water to drip from the inner channel 65 of the upper siding panel 40 onto the first upper inclined surface 50 thereby shedding water away from the building wall 2, to the extent water is accumulated in the inner channel 65.

The siding panels 10, 40 can be made of any material. Preferably, the siding panels 10, 40 are manufactured from a metal material, such as steel or aluminum. The siding panels 10, 40 can be painted and/or coated to appear like a wooden plank. Thus, when the siding panel 10 is installed on a building wall 2, the siding panel 10 will appear to be adjacent planks of wood secured next to one another. However, the siding panel 10 has the benefit of durability, integral water shedding, hidden securing flanges, and customizable color/patterns in the painting and/or coating, providing many advantages over traditional wooden siding products. Similarly, the siding panel 40 with the recessed face 54 can have the similar advantages over wooden planks when installed on a building wall 2, with the added benefit of having a recessed face 54, which gives the appearance of a channeled wood product while maintaining the durability, the customization options with paint, pattern, and color, and with the integral water weeping capability.

As illustrated in the drawings, the panels 10, 40 can be installed horizontally as traditional siding. The panels 10, 40 can also be installed vertically or on angles. The panel 10, 30 can also be used as soffit, as underdecking, or in other overhead arrangements.

Those skilled in the art will recognize, or will be able to ascertain using no more than routine experimentation, many equivalents to the specific embodiments of the invention described herein. Such equivalents are intended to be encompassed by the following claims.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

It will be understood by one having ordinary skill in the art that construction of the present disclosure and other components is not limited to any specific material. Other exemplary embodiments of the disclosure disclosed herein may be formed from a wide variety of materials, unless described otherwise herein.

It is also important to note that the construction and arrangement of the elements of the present disclosure as shown in the exemplary embodiments is illustrative only. Although only a few embodiments of the present innovations have been described in detail in this disclosure, those skilled in the art who review this disclosure will readily appreciate that, unless otherwise described, many modifications are possible (e.g., variations in sizes, dimensions, structures, shapes, and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating positions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

The invention claimed is:

1. An elongated sliding panel to be attached to a building, comprising:

an elongated body having an inner face and an outer face, comprising:

a securing flange portion near an upper end of the said elongated body, said securing flange portion being generally parallel to said outer face when said elongated body is attached to a surface of a building;

said securing flange portion being spaced away from said outer face of said elongated body a first distance to space said inner face of said elongated body a distance away from the building when said elongated body is attached to the surface of the building;

a receiving channel located near a bottom of said securing flange; and a plurality of stiffening ridges in said securing flange portion;

a tab portion near a lower end of said elongated body, said tab portion being generally parallel to said outer face when said elongated body is attached to a surface of a building;

said tab portion being spaced away from said outer face of said elongated body a second distance;

an inner channel formed by a lower inclined surface between said inner face of said elongated body and said tab portion;

an upper inclined edge located near the upper end of said elongated body; and wherein said second distance is smaller than said first distance.

2. The elongated siding panel of claim 1, further including:

a recessed face portion located near said upper end of said elongated body, said recessed face portion extending from said upper inclined edge, with a second upper inclined edge extending from said recessed face portion toward said securing flange.

3. The elongated siding panel of claim 2, wherein said receiving channel is formed between a downward extension from said second inclined edge and a portion of said securing flange.

4. The elongated siding panel of claim 1, wherein said panel is installed in a soffit.

5. The elongated siding panel of claim 1, wherein the plurality of stiffening ridges are generally parallel to said outer face of said elongated body.

6. The elongated siding panel of claim 5, wherein said plurality of stiffening ridges have a curved shape.

7. The elongated siding panel of claim 2, wherein an angle between said upper inclined edge and said recessed face portion is in the range of 110° to 120°.

8. The elongated siding panel of claim 1, wherein said tab portion includes a flange that is compressed when said tab portion is placed into a receiving channel of an adjacent elongated siding panel.

9. The elongated siding panel of claim 1, wherein said elongated body is formed from metal.

10. A building siding system, comprising:

a generally vertically extending building wall;

a siding panel having an elongated body with a generally horizontal upper end and a generally horizontal lower end when said siding panel is secured in a generally horizontal orientation to said building wall, said elongated body having an outer face oriented away from said building wall and an inner face oriented toward said building wall;

a securing flange extending from said siding panel with a plurality of stiffening ridges, said securing flange being spaced away from said outer face of said elongated body a first distance, fasteners secured through said securing flange to attach said siding panel to said building wall;

a receiving channel, located between a portion of said securing flange and a generally vertical portion of said siding panel spaced away from said securing flange, a bottom of said receiving channel being generally U-shaped;

a tab portion located near said generally horizontal lower end of said elongated body, being spaced away from said outer face of said elongated body a second distance;

an inner channel formed by a lower inclined surface that extends from a bottom of said generally horizontal lower end to a top of said tab portion;

a first upper inclined edge that extends from said generally horizontal upper end toward a portion of said securing flange; and wherein said second distance is smaller than said first distance.

11. The building siding system of claim 10, wherein walls of said receiving channel are generally parallel when the panel is installed in a soffit.

12. The building siding system of claim 10, wherein a portion of walls of said receiving channel are spaced apart the approximate thickness of said tab portion.

13. The building siding system of claim 10, wherein said tab portion includes a hinged portion that compresses when said tab portion of one panel is inserted into the receiving channel of an adjacent siding panel.

14. The building siding system of claim 10, wherein said siding panel is metal.

15. The building siding system of claim 10, further including:

a recessed face portion located near said upper end of said elongated body, said recessed face portion extending vertically from said first upper inclined edge, with a second upper inclined edge extending from said recessed face portion toward said securing flange.

16. The building siding system of claim 15, wherein said receiving channel is formed between a downward extension from said second upper inclined edge and a portion of said securing flange.

17. The building siding system of claim 10, wherein said stiffening ridges are curved.

18. An insert for an elongated siding panel as claimed in claim 1, comprising:

a body with an outer surface and an inner surface that is generally parallel to said outer surface, an upper inclined surface that extends from the upper end of said outer surface; and a lower inclined surface that extends from the lower end of said outer surface to the lower end of said inner surface.

19. The insert of claim 18, including a shoulder formed between the upper end of said inner surface and a portion that is generally parallel to said outer surface and said inner surface, that extends downward from the upper end of said upper inclined surface.

20. The insert of claim 18, wherein said body is made from foam.

* * * * *